United States Patent [19]

Fukukura

[11] 4,425,484

[45] Jan. 10, 1984

[54] ENCODED KEYBOARD SWITCH

[75] Inventor: Kazutoyo Fukukura, Reading, Mass.

[73] Assignee: AMP Incorporated, Harrisburg, Pa.

[21] Appl. No.: 285,898

[22] Filed: Jul. 23, 1981

[51] Int. Cl.[3] ..... H01H 13/70

[52] U.S. Cl. ..... 200/5 A; 200/159 B; 200/292

[58] Field of Search ..... 200/1 R, 5 R, 5 A, 86 R, 200/159 B, 292; 361/398

[56] References Cited

U.S. PATENT DOCUMENTS

| | | | |
|---|---|---|---|
| 3,551,616 | 12/1970 | Juliusburger et al. | 200/46 |
| 3,566,049 | 2/1971 | Wright | 200/5 R |
| 3,617,666 | 11/1971 | Brave | 200/86 R |
| 3,627,935 | 12/1971 | Splevak | 200/5 R |
| 3,663,779 | 5/1972 | Gerlach et al. | 200/86 R X |
| 3,676,615 | 7/1972 | Wiedmer | 200/5 R |
| 3,723,673 | 3/1973 | Clary et al. | 200/1 R |
| 3,917,917 | 11/1975 | Murata | 200/5 R X |
| 3,969,595 | 7/1976 | Johnson | 200/5 A |
| 3,982,081 | 9/1976 | Delmer, Jr. | 200/5 R |
| 4,066,851 | 1/1978 | White et al. | 200/5 A |
| 4,246,452 | 1/1981 | Chandler | 200/5 A |
| 4,356,358 | 10/1982 | Fukukura | 200/5 A |

*Primary Examiner*—J. R. Scott

*Attorney, Agent, or Firm*—Frederick W. Raring

[57] ABSTRACT

An encoded keyboard switch comprises a plurality of key positions. Each key position has first and second membrane switches associated therewith. The first switch is immediately beneath the key top and the second switch is beneath the first switch. The first membrane switch has first switch contacts which are commonly connected to a first common external conductor. The second switch contacts of the first membrane switch have output conductors extending therefrom to external signal conductors. The second switch contacts are selectively connected to each other by encoding conductors. Each second associated membrane switch has third switch contacts which are commonly connected to a second common external conductor, and fourth switch contacts which are commonly connected to an internal conductor that is commonly connected to the first contacts of the first associated membrane switches of the key positions. Upon depression of a top key, the first associated membrane switch closes initially and then the second associated membrane switch is closed, thereby ensuring that the proper output signals will be sent out through the external signal conductors.

4 Claims, 11 Drawing Figures

| | SIGNAL CONDUCTOR 64-8 BIT | SIGNAL CONDUCTOR 68-4 BIT | SIGNAL CONDUCTOR 70-2 BIT | SIGNAL CONDUCTOR 66-1 BIT | COMMON CONDUCTOR 54 | COMMON CONDUCTOR 84 |
|---|---|---|---|---|---|---|
| 1 | | | | X | X | X |
| 2 | | | X | | X | X |
| 3 | | | X | X | X | X |
| 4 | | X | | | X | X |
| 5 | | X | | X | X | X |
| 6 | | X | X | | X | X |
| 7 | | X | X | X | X | X |
| 8 | X | | | | X | X |
| 9 | X | | | X | X | X |
| 10 | X | | X | | X | X |
| 11 | X | | X | X | X | X |
| 12 | X | X | | | X | X |

X INDICATES OUTPUT LINES WHICH ARE ENERGIZED WHEN KEYTOP IS DEPRESSED.

24
1a
1b
1c
1d
2a
2b
2c
2d
3a
3b
3c
3d
4a
4b
4c
4d
5c
6a
6b
6c
6d
7a
7b
7c
7d
8b
8c
8d
9a
9b
9c
9d
10a
10b
10c
10d
11a
11b
11c
11d
12a
12b
12c
12d
25
26
28
30
32
34
36
37
38
40
42
44
46
48
50
52
54
56
58
60
62
64
66
68
70
72
74
76
78
80
82
84
86
88

ENCODED KEYBOARD SWITCH

FIELD OF THE INVENTION

This invention relates to keyboard switches of the type which are encoded by internal logic that is achieved by circuit conductors contained in the switch.

BACKGROUND OF THE INVENTION

U.S. Pat. No. 3,721,778 describes a keyboard switch which has its own internal logic to provide an encoded output. The output is achieved without the necessity of using logic devices external to the switch as is required, for example, in a conventional matrix encoded keyboard switch. The keyboard switch described in U.S. Pat. No. 3,721,778 is sound in principle in that it permits the elimination of solid state circuit devices which are otherwise required to interpret the output of most keyboard switches. The physical structure of the keyboard described in U.S. Pat. No. 3,721,778 is, however, relatively complex and a switch as described in that U.S patent involves some difficult manufacturing and assembly operations. The present invention, in accordance with one aspect thereof, is directed to the achievement of a keyboard switch having its own internal logic for encoding which can be manufactured with relative ease by commonly understood and easily executed switch manufacturing processes.

It is important in keyboard switches that the signals which are transmitted from the switch to be valid signals which accurately convey the intelligence or information which was intended by the person operating the switch. Problems can arise, under some circumstances, if the person operating the switch does not carefully depress the key tops or the keys of a membrane switch in that inaccurate signals may be produced as a result of the fact that the circuits which are intended to be energized are not energized. In other words, if the operator only partially depresses the key top of a keyboard switch and only some of the necessary circuits are energized, information may be transmitted by the switch which is faulty, in that it is not the same information which the operator intended to transmit.

The present invention in accordance with a further aspect thereof, is directed to the achievement of a keyboard switch which has internal circuitry that ensures that any signal or information produced in the switch accurately reflects the intention of the operator of the keyboard switch.

An encoded keyboard switch assembly in accordance with the invention has a plurality of key positions, each key position having a key top and a first associated membrane switch immediately beneath the key top. Depression of the key top thus closes the first associated membrane switch immediately. Each first associated membrane switch has first and second switch contacts, the first switch contacts being commonly connected to a first common external conductor extending from the switch assembly. The second switch contacts have output conductors extending therefrom to external signal conductors. The second switch contacts are selectively connected to each other by encoding conductors in accordance with an encoding scheme, such as a hexadecimal encoding scheme. Each of the key positions also has a second associated membrane switch which is beneath the first associated membrane switch. Each second associated membrane switch has third and fourth switch contacts. The third contacts are commonly connected to a second common external conductor and the fourth contacts are commonly connected to an internal conductor, which is in turn commonly connected to the first contacts of the first associated membrane switches. The arrangement is such that information cannot be sent through the signal conductors until the second associated membrane switch contacts are closed. The information sent is therefore an accurate transmission of the information intended by the operator who depresses the key top.

PREFERRED EMBODIMENT OF THE INVENTION

Figure 1:
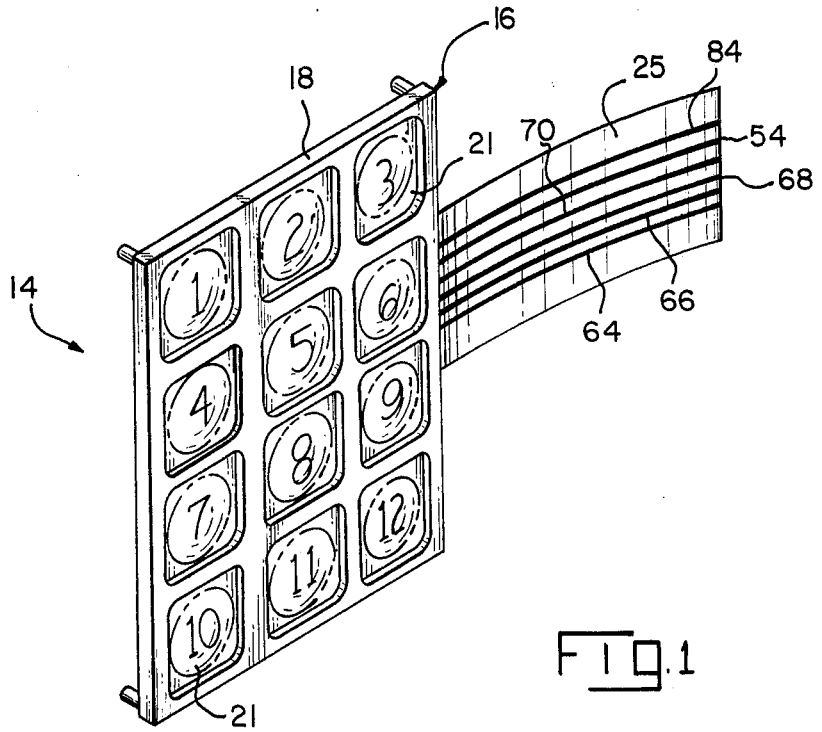
FIG. 1 is a perspective view of an encoded keyboard switch.

A keyboard switch assembly 14 in accordance with the invention (FIGS. 1 and 2) comprises a rectangular housing 16 having a bezel 18, a backplate 20, and a folded flexible circuit 22. A rectangular array of key tops 21 is provided in the bezel 18, each key top being identified by a number. The term "key top" is used here to denote the surface which is pressed when it is desired to send a signal from the keyboard switch. This term "key top" is also commonly used in the electrical industry to denote a key member which is biased by a separate spring and which, when depressed, closes an individual switch on a keyboard. The present invention can be used with the latter type of "key top." The embodiment shown is similar to a conventional keyboard of the type used in telephones and has key positions 1–12.

The folded circuit 22 is contained between the underside of the bezel and the backplate 20 and the folded circuit has membrane switches and conductors as will be described below, which are beneath the key top positions 1–2. When a predetermined key top is depressed, switches are closed in the folded circuit 22 to produce an output signal in conductors on the tail 25 which extends from the folded circuit.

The structure of the folded circuit 22 can best be understood from a description of the manner in which this folded circuit is manufactured. A description of the manufacture will now be presented, with reference to FIGS. 4–10.

Folded circuit 22 is produced from a flat rectangular sheet 24 of flexible film, such as polyester film. The sheet 24 has upper and lower edges 26, 28 as viewed in FIG. 4, end edges 38, 40, and a tail 25 which extends from the righthand end edge 40. Centrally located notches 30 are provided in the edges 26, 28 midway between the end edges 38, 40 and a slit 32 is formed which is in alignment with these notches. An additional pair of notches 34 are provided in edges 26, 28 midway between the notches 30 and the righthand end edge 40. A further pair of notches 36 are provided in edges 26, 28 between the notches 30 and the lefthand end edge 28. Slits 37 are formed in the film in alignment with the notches 34, 36. The notches 30, 34, 36 divide the sheet 24 into four sections 42, 44, 46, and 48. Circuitry as described below is formed on the upper surface of the film as viewed in FIG. 4, and this circuitry will now be described on each section.

The section 44 of the film 24 which is to the right of the slit 32 has switch contacts thereon located such that they will be beneath the key top positions 21 in the assembled keyboard switch. The switch positions are indicated by the reference numerals 1*a*, 2*a*, 3*a* - - - 11*a*, 12*a*. For reasons which will be explained below, the sequence of switch positions on section 44 extends from right to left in FIG. 4, that is, position 1*a* is adjacent to notch 34 while position 3*a* is adjacent to notch 30. To avoid overcrowding, not all of the contacts 1*a*, 2*a* - - - 11*a*, 12*a* have reference numerals. However, the identity of all of these contacts can be determined from the reference numerals applied to the drawing.

The twelve switch contacts, 1*a*–12*a*, are commonly connected by means of commoning conductors 50 and a conductor 52 extends from switch contact 1*a* across section 42 of the sheet of film to a first common external conductor 54 on the tail 25.

Figures 4, 5, 6:
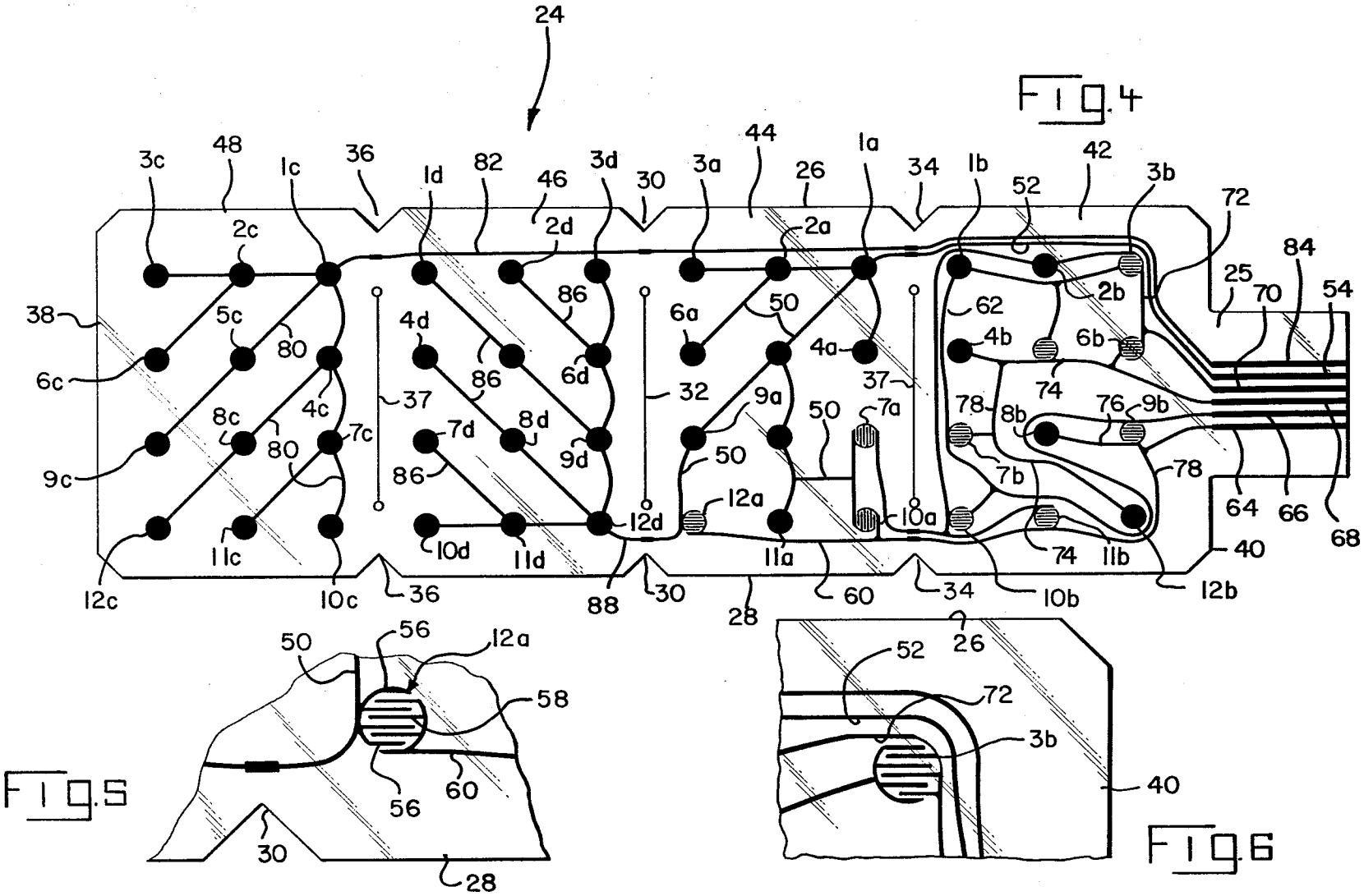
FIG. 4 is a plan view of a flexible circuit which, upon folding, becomes the folded flexible circuit shown in FIG. 2 of the keyboard switch assembly.
FIGS. 5 and 6 are plan views on an enlarged scale of two-pole switch contacts which are provided on the circuit shown in FIG. 4.
Figure 7:
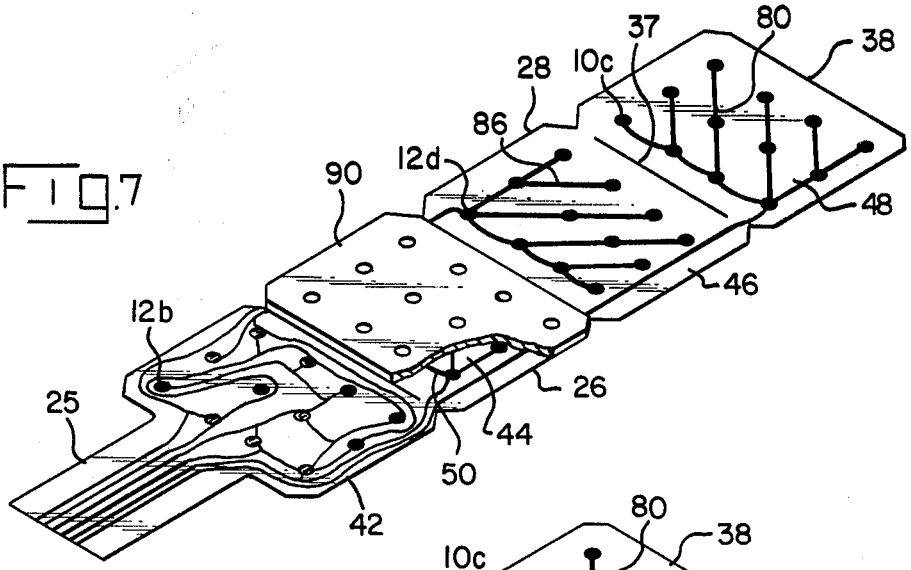
FIG. 7 is a perspective view of the flexible circuit with a separator positioned on the surface thereof in preparation for folding.

Switch contacts 7*a*, 10*a*, and 12*a* on section 44 are two-pole contacts of the type shown in FIGS. 5 and 6. In FIG. 5, the two-pole contact 12*a* has first straight conductors 56 which extend from a commoning conductor 50 and second straight contact conductors 58 which extend from a conductor 60 that extends onto section 42 adjacent to the lower edge 28 of the film. There is, therefore, normally no closed circuit path from the conductor 50 in FIG. 5 to the conductor 60, but when the two-pole contact of FIG. 5 is engaged with a switch contact 12*b* on the second section 42, a circuit will extend from contact 12*b* to both of the conductors 50, 60.

Figures 3, 11:
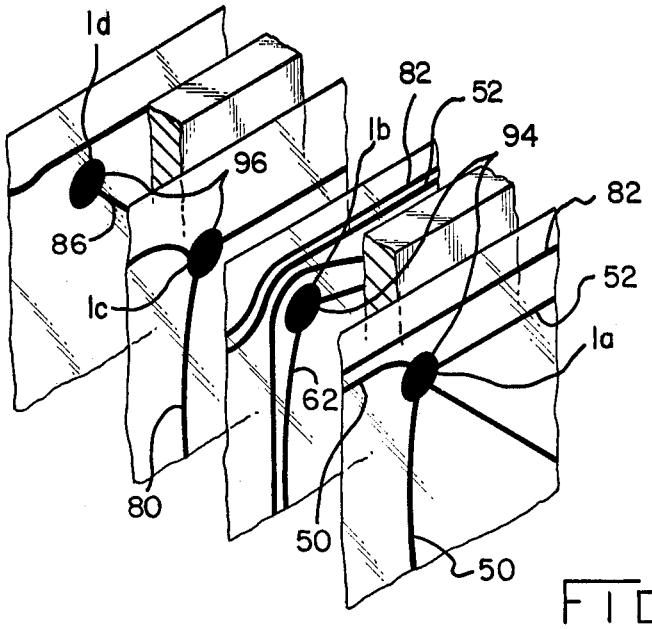
FIG. 3 is a perspective view, on an enlarged scale, of a corner portion of a folded flexible circuit which forms part of the keyboard switch of FIGS. 1 and 2.
FIG. 11 is a diagram of a type commonly called a truth table, which explains the encoding scheme of the switch of FIG. 1.

The section 42 of the film has switch contacts 1*b*, 2*b*, 3*b* - - - 11*b*, 12*b* thereon. The location of these contacts is such that if the section 42 is folded along the slit 37 towards the section 44, the corresponding switch contactors will be opposed to each other. That is, the first contact 1*a* will be opposed to the second contact 1*b* and these two switch contacts form a first membrane switch 94. FIG. 3, which is beneath key top 1 of the keyboard switch assembly. In like manner, the other switch contacts on section 42 will be opposed to their numerical counterparts after folding.

Contacts 3*b*, 5*b*, 6*b*, 7*b*, 9*b*, 10*b*, and 11*b* are two-pole switch contacts as described with reference to FIG. 5, The two-pole switch contact at 3*b* is shown in detail in FIG. 6.

Output conductors extend from selected switch contacts on the section 42 to external signal conductors 64, 66, 68, and 70 on the tail 25. The signal conductor 64 is the eight bit output for the hexadecimal encoding scheme and the conductor 76 extends directly from switch contact 8*b* to the signal conductor 64. The signal conductor 66 is the one bit signal conductor and an output conductor 62 extends from switch contact 1*b* directly to the signal conductor 66. In like manner, a conductor 72 extends from switch contact 2*b* to the two bit signal conductor 70 and a conductor 74 extends from switch contact 4*b* to the four bit signal conductor 68. Additional conductors are provided on the section 42 as shown at 78 and extend selectively between the switch contacts 1*b*–12*b*. The conductors 78 are encoding conductors and carry signals when key tops are depressed, which require a signal in more than one of the external signal conductors 64, 66, 68, 70.

FIG. 11 shows the circuits which must be energized for each of the key positions in the membrane switch assembly. A study of FIGS. 4 and 11 will demonstrate that the signal conductors required for a given key position will be energized when the key top is depressed, by virtue of the presence of the encoding conductors 78.

The section 48 of the film 24 has third switch contacts 1*c*, 2*c* - - - 11*c*, 12*c*, which are commonly connected by commoning conductors 80 that extend to switch contact 1*c*. A conductor 82 extends from contact 1*c* across the sections 46, 44, and 42, to a second common external conductor 84 on the tail 25. The section 46 of the sheet 24 has fourth switch contacts 1*d*, 2*d*, - - - 11*d*, 12*d* thereon, which are commonly connected by conductors 86 to the switch contact 12*d* and a conductor 88 extends from contact 12*d* onto section 44 where it is connected to a commoning conductor 50 on that section.

In the appended claims, the section 44 of film is regarded as the first section and the switch contacts 1*a*, 2*a*, 3*a*, etc. are recited as first contacts of the first switch. The section 42 of film is recited as a second section and the contacts 1*b*, 2*b*, 3*b*, etc. are set forth as second contacts of the first switch. The section 48 of film is recited as the third section and the switch contacts 1*c*, 2*c*, 3*c*, etc. are recited as third contacts of the second switch. The section 46 of film is recited as the fourth section and the contacts 1*d*, 2*d*, 3i d, etc. are recited as fourth contacts of the second switch.

The flat flexible circuit shown in FIG. 4 can be manufactured by conventional known manufacturing techniques, as by silkscreening conductive ink on the surface to produce the switch contacts and the conductors shown in FIG. 4. Alternatively, the conductors and switch contacts can be produced by electrodeposition of metallic conductors on the surface of the film.

Figure 2:
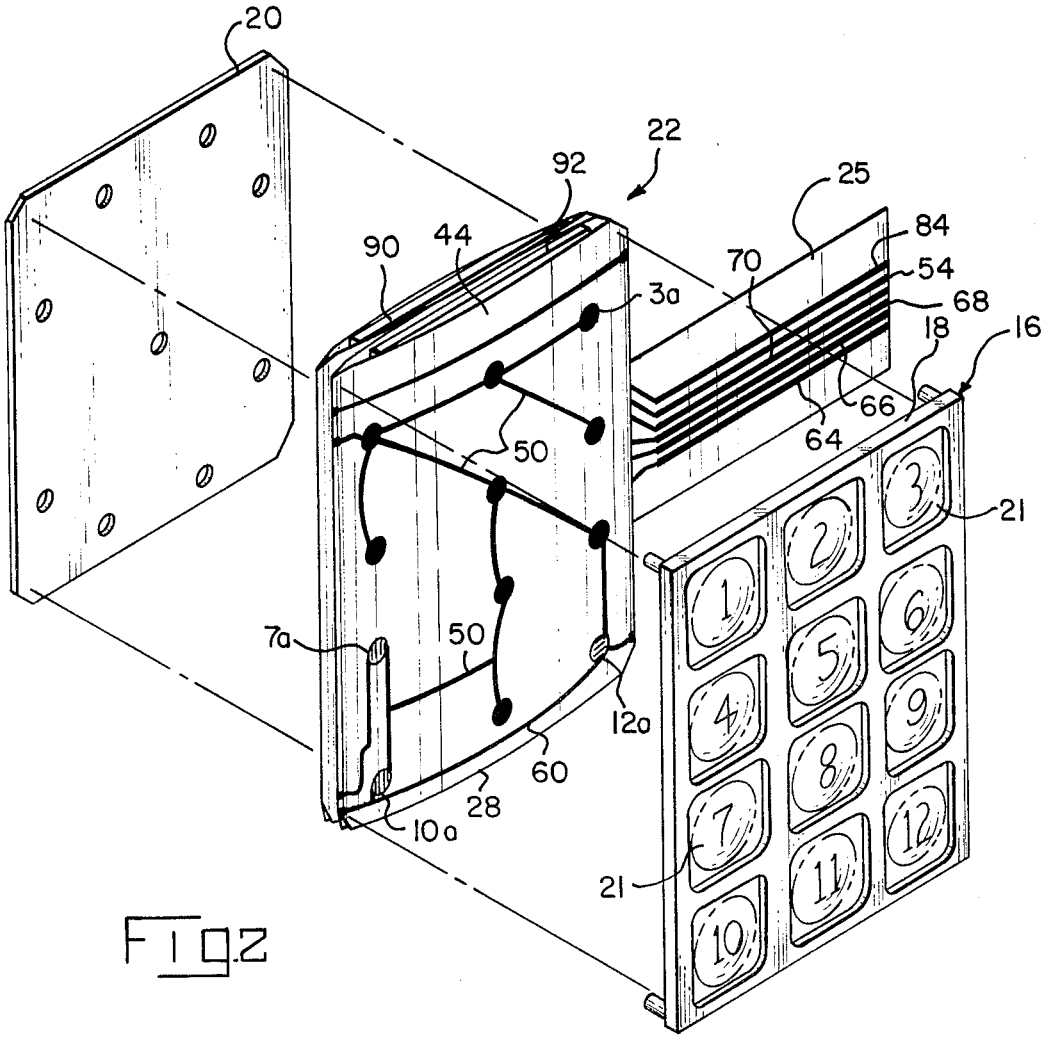
FIG. 2 is a view showing the switch parts exploded from each other.
Figure 8:
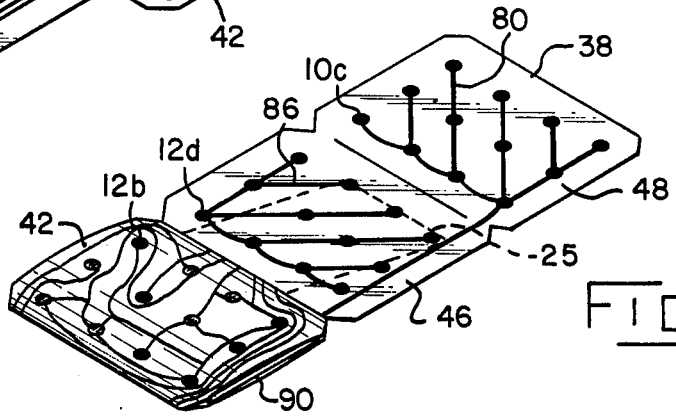
FIGS. 8 and 9 illustrate the manner in which the circuit of FIG. 7 is folded.
Figure 9:
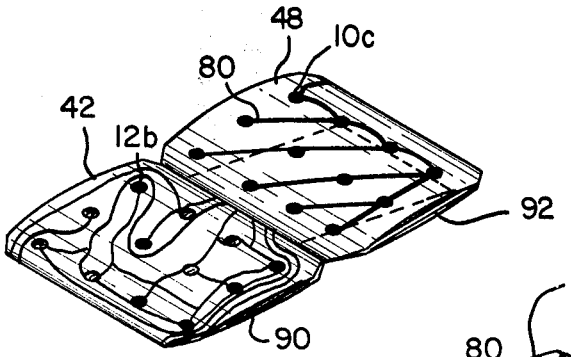
Figure 10:
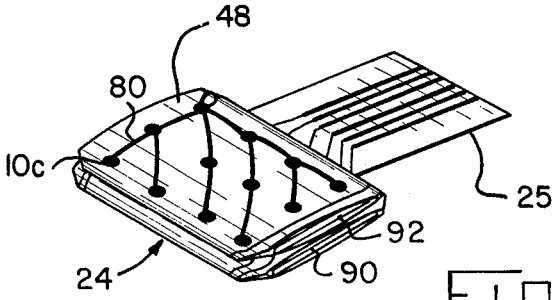
FIG. 10 is a perspective view of the folded circuit which can now be assembled to the frame and backplate of the keyboard switch assembly of FIG. 1.

As shown in FIGS. 7–10, the folded circuit 22 is produced by positioning a separator 90 on the surface of the section 44 and then folding the section 42 towards the section 44 and inserting the tail 25 through the slit 32, see FIG. 8. The separator 90 has openings therein in alignment with the switch contacts so that the first membrane switches associated with each key top can be closed by depressing the key top. The section 48 is then folded towards the section 46 and a separator 92 is positioned between these two sections as shown in FIG. 9. Thereafter, the two sections 48, 46 are folded as a unit towards the two sections 42, 44, as shown in FIG. 10. The folded circuit can then be oriented properly as shown in FIG. 2 and assembled to the bezel 18 and backplate 20 of the switch assembly.

FIG. 3 illustrates that for each key position there is a first associated membrane switch 94 and a second associated membrane switch 96. FIG. 3 shows the associated membrane switches for key position 1. The switch contact 1*a* is the first contact, the contact 1*b* is the second contact, the contact 1*c* is the third contact, and the contact 1*d* is the fourth contact.

It will be apparent that an encoded switch in accordance with the invention can be produced by extremely simple manufacturing processes that involve no steps beyond the manufacture of membrane switches for a keyboard. The encoding is achieved by adding the encoding conductors 78 on the surface of the section 42 when the conductors on the switch contacts are produced on the film 24 by silkscreening conductive ink or electrodeposition.

While the disclosed embodiment of the invention has a hexadecimal encoding scheme, other encoding schemes can be produced by proper location of the encoding conductors. It should also be mentioned that symbols other than numerals might be provided on the key tops. Examples of other types of symbols would be letter symbols or picture symbols of the type used on a child's electronic toy or a teaching aid. Under some circumstances, multi-layer conductors may be produced, as where crossovers are needed for the encoding scheme. To produce crossovers, it would merely be necessary to silkscreen insulating material selectively on some of the conductors on the film 24 and then silkscreen additional conductors on the layer of insulating material.

FIG. 11 shows that no information can be transmitted from the signal conductors unless the switch contacts in the second membrane switch 96 are closed. This arrangement ensures that faulty signals will not be transmitted when the operator carelessly presses on the key top of a key position of the keyboard switch. Carelessness may result in closing of the first membrane switch 94 of the key position in a way which would not result in energizing all of the encoding conductors required, but such careless practice would not result in closing of the second membrane switch 96. Thus, no output would be achieved and the user of the switch would immediately be aware that he had not transmitted the information he intended to transmit. The second membrane switch 96 of each key position can therefore be described as a verification switch which provides a strobe effect.

The particular folding technique disclosed herein is one technique which can be used to manufacture encoded switches in accordance with the invention. This folding technique, however, can be used under many other circumstances where superimposed switches in an array are required and in which encoding may be neither required nor desirable. The folding technique is described more fully in application Ser. No. 279,289 filed July 1, 1981 and now U.S. Pat. No. 4,356,358 issued Nov. 26, 1982.

I claim:

1. An encoded keyboard switch assembly, said switch assembly being a substantially flat panel-like member having a top surface and having a plurality of key positions on the top surface, the switch assembly being characterized in that:

each of said key positions has a key top and a first associated membrane switch beneath said key top so that depression of said key top closes said first associated membrane switch, each first associated membrane switch having opposed first and second switch contacts, said first switch contacts being commonly connected to a first common external conductor extending from said switch assembly, said second switch contacts having output conductors extending therefrom, said output conductors extending to external signal conductors, said second switch contacts are selectively connected to each other by encoding conductors in accordance with a predetermined encoding scheme, at least some of said second switch contacts and at least some of said first switch contacts being multi-pole contacts, said multi-pole contacts being preselected to achieve said encoding scheme, each of said key positions has a second associated membrane switch beneath, and in alignment with, said first associated membrane switch, said second associated membrane switches having third switch contacts which are commonly connected to a second common external conductor, said second associated membrane switches having fourth contacts which are commonly connected to a common internal conductor, said common internal conductor being commonly connected to said first contacts of said first associated membrane switches, said switch assembly comprising first, second, third and fourth sections of flexible film, said sections being stacked beneath said top surface with said first section adjacent to said top surface, each of said first membrane switches being on the opposed surfaces of said first and second sections with said first switch contacts and said first common external conductor being on said first section and with said second switch contacts and said encoding conductors being on said second section, each of said second membrane switches being on the opposed surfaces of said third and fourth sections with said third switch contacts and said second common external conductor being on said third section, and with said fourth switch contacts and said common internal conductor being on said fourth sections whereby, upon depression of one of said key tops, the first associated membrane switch beneath said one key top is closed and subsequently the second associated membrane switch is closed, and after closure of said second associated membrane switch, output signals are transmitted through said external signal conductors in accordance with said encoding scheme.

2. An encoded keyboard switch assembly as set forth in claim 8, said switch assembly being encoded with a binary code.

3. An encoder keyboard switch assembly as set forth in claim 8, said switch assembly being encoded with a hexidecimal code, said external signal conductors comprising a one bit signal conductor, a two bit signal conductor, a four bit signal conductor, and an eight bit signal conductor.

4. A encoded keyboard switch assembly as set forth in claim 3, said switch assembly having twelve key positions arranged in a rectangular array, the first switch contacts of the first membrane switches at the seventh, tenth, and twelfth positions being double pole contacts, the second switch contacts of the first membrane switches at the third, fifth, sixth, seventh, ninth, tenth, and eleventh positions being double pole contacts.

* * * * *